US008493424B2

(12) United States Patent
Tsuchiya et al.

(10) Patent No.: US 8,493,424 B2
(45) Date of Patent: Jul. 23, 2013

(54) PRINTER

(75) Inventors: Masahiro Tsuchiya, Tokyo (JP); Yukihiro Mori, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 13/484,450

(22) Filed: May 31, 2012

(65) Prior Publication Data

US 2012/0327167 A1 Dec. 27, 2012

(30) Foreign Application Priority Data

Jun. 22, 2011 (JP) ..... 2011-138863

(51) Int. Cl.
*B41J 11/00* (2006.01)

(52) U.S. Cl.
USPC ..... 347/220

(58) Field of Classification Search
USPC ..... 347/220, 222
See application file for complete search history.

(56) References Cited

U.S. PATENT DOCUMENTS

| | | | | |
|---|---|---|---|---|
| 4,832,306 | A | 5/1989 | Bossack | |
| 6,249,302 | B1 * | 6/2001 | Sekiya | 347/220 |
| 6,412,995 | B2 * | 7/2002 | Togashi et al. | 347/220 |
| 7,446,790 | B2 * | 11/2008 | Takabatake | 347/220 |
| 2007/0091162 | A1 * | 4/2007 | Takabatake | 347/220 |
| 2007/0291100 | A1 * | 12/2007 | Kang et al. | 347/220 |

FOREIGN PATENT DOCUMENTS

| | | |
|---|---|---|
| EP | 0430561 | 6/1991 |
| EP | 2093071 | 8/2009 |
| JP | 07-237324 | 9/1995 |
| WO | WO2012/058017 | 5/2012 |

* cited by examiner

*Primary Examiner* — Kristal Feggins
(74) *Attorney, Agent, or Firm* — IPUSA, PLLC

(57) ABSTRACT

A printer includes a platen roller, a motor configured to rotate the platen roller, and a frame configured to rotatably support the platen roller, the motor being mounted to the frame, wherein the motor has a shaft and a face that is in contact with the frame, and the face has a flange at a periphery thereof and a boss around the shaft, wherein the frame has a U-letter-shape opening into which the boss of the motor is insertable in a direction perpendicular to an axis of the shaft, and also has a fitting part in which the flange of the motor is engaged, and wherein the motor is fixedly positioned by the boss being inserted into the U-letter-shape opening of the frame and by the flange being engaged in the fitting part.

4 Claims, 7 Drawing Sheets

PRINTER

BACKGROUND OF THE INVENTION

1. Field of the Invention

The disclosures herein relate to a printer.

2. Description of the Related Art

Thermal printers with a thermal printing unit having a thermal head and a platen roller are widely used as embedded printers in cash registers, portal terminal devices, and ATMs (automatic teller machines), etc. In a thermal printer, the platen roller feeds thermal paper, and printing on the thermal paper is typically performed between the platen roller and the thermal head that is pressed against the platen roller by a head spring. The platen roller has a gear at an end of the shaft, and is rotatably supported by a frame. The platen roller rotates in response to drive force supplied through a reduction gear from a motor that is assembled with the frame. The frame has an opening into which the motor shaft is inserted, and also has screw holes or the like for fixedly mounting the motor. With the shaft being inserted into the frame, the motor is positioned and fixed by screws.

Assembling the motor with the frame involves a series of tasks including inserting the shaft into the frame, aligning the motor with the screw holes, and fastening the screws while constantly adjusting the position of the motor based on visual inspection. This may result in productivity being lowered.

It may be desired to provide a thermal printer, for which the task of positioning and fixing the motor being assembled with the frame is simplified, thereby allowing reliable fixed mounting of the motor.

[Patent Document 1] Japanese Patent Application Publication No. 7-237324

SUMMARY OF THE INVENTION

According to an embodiment, a printer includes a platen roller, a motor configured to rotate the platen roller, and a frame configured to rotatably support the platen roller, the motor being mounted to the frame, wherein the motor has a shaft and a face that is in contact with the frame, and the face has a flange at a periphery thereof and a boss around the shaft, wherein the frame has a U-letter-shape opening into which the boss of the motor is insertable in a direction perpendicular to an axis of the shaft, and also has a fitting part in which the flange of the motor is engaged, and wherein the motor is fixedly positioned by the boss being inserted into the U-letter-shape opening of the frame and by the flange being engaged in the fitting part.

According to at least one embodiment, the motor is fixedly positioned by simply inserting the motor into the U-letter-shape opening formed in the frame, thereby simplifying the task of mounting the motor to increase productivity. With this arrangement, further, the motor is reliably fastened.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

In the following, embodiments of the present invention will be described in detail with reference to accompanying drawings.

Figure 1B:
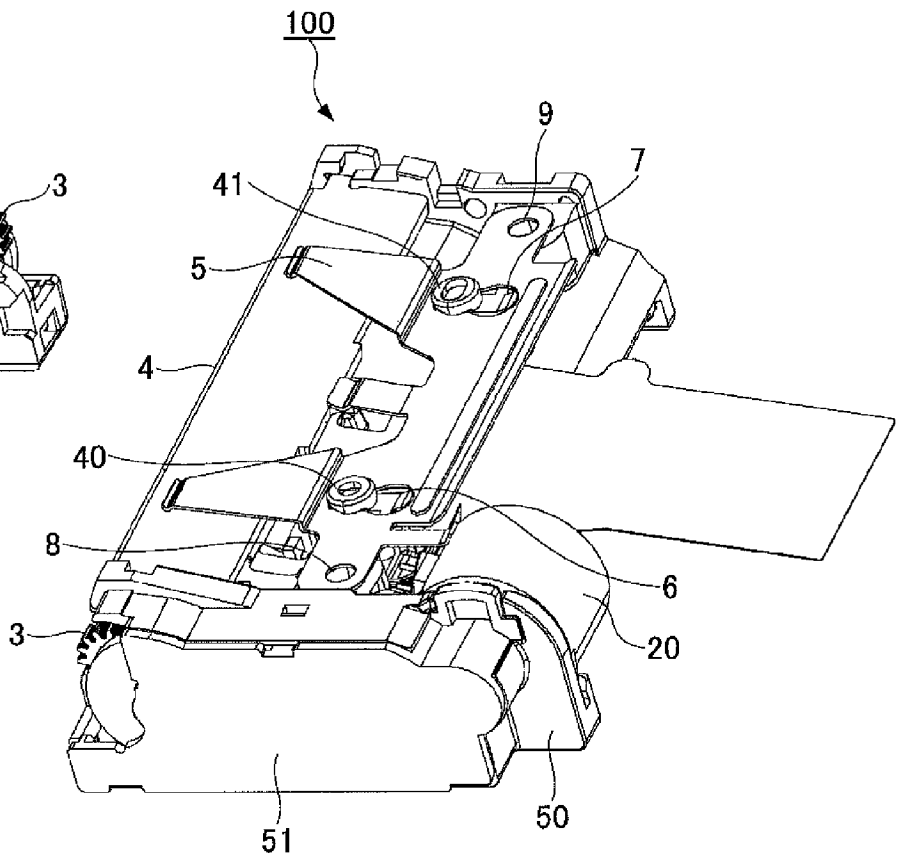
FIGS. 1A and 1B are oblique perspective views of a thermal printer according to an embodiment.
Figure 1A:
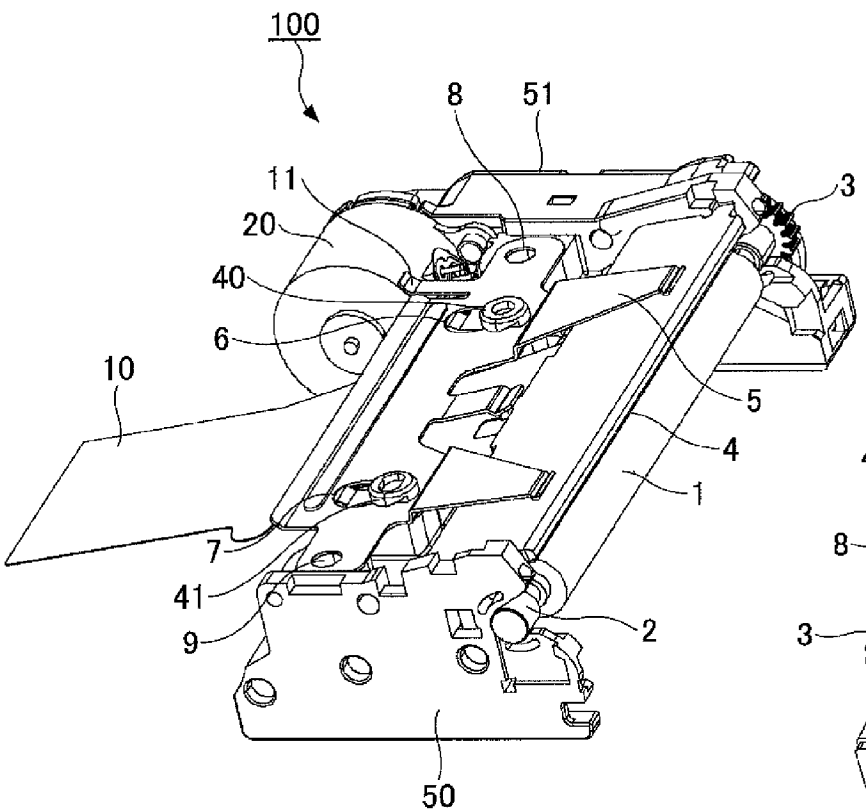

FIGS. 1A and 12 are oblique perspective views of a thermal printer according to an embodiment. FIGS. 1A and 1B illustrate views of a thermal printer 100 taken from different directions.

A frame 50 has two sideboards for supporting a platen roller 1 and a thermal head 4. One of the two sideboards supports a motor 20. A head spring 5 is provided at the center of the frame to press the thermal head 4 against the platen roller 1. The frame 50 is made by molding a resin material into a single, continuous, unitary structure including a main body and the sideboards.

The platen roller 1 has a gear 3 situated at one end of the shaft and a shaft bearing 2 situated at either end of the shaft, and is rotatably supported by the sideboards of the frame 50. The platen roller 1 rotates in response to drive force from the motor 20 to transport thermal paper (not shown) wrapped around the platen roller 1.

The thermal head 4 is supported by the sideboards of the frame 50, and is urged toward the platen roller 1 by the head spring 5 attached to the center of the frame 50. The thermal paper transported by the platen roller 1 passes through a gap between the thermal head 4 and the platen roller 1, with the thermal head 4 printing on the surface of the thermal paper.

The thermal head 4 receives print data from a control board (not shown) through a flexible printed circuit board 10 to print on the thermal paper according to the received print data.

The head spring 5 urging the thermal head 4 against the platen roller 1 is a plate-shape member made of metal material. The head spring 5 is fixedly engaged with bosses 40 and 41 formed around the center of the frame 50.

The motor 20 is attached to inside a sideboard of the frame 50. The drive force of the motor 20 propagates to the gear 3 through a reduction gear (not shown) situated inside a gear cover 51, thereby rotating the platen roller 1.

Figure 2B:
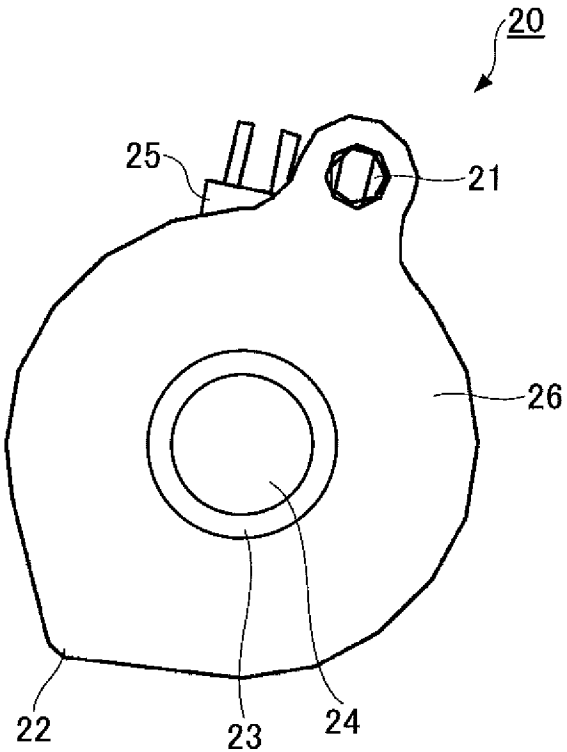
FIGS. 2A and 2B are an oblique perspective view and a lateral view of a motor, respectively, according to the embodiment.
Figure 2A:
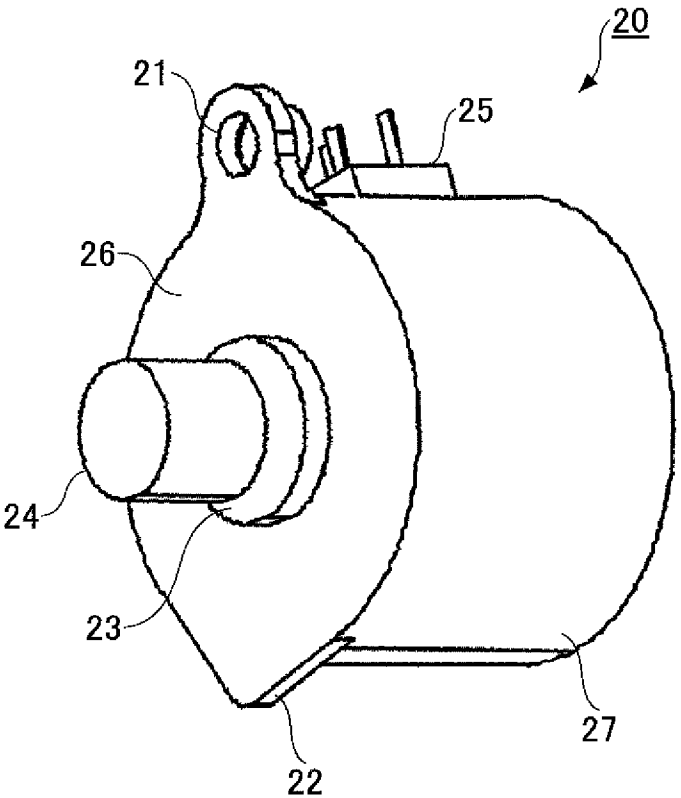

FIGS. 2A and 2B are an oblique perspective view and a lateral view of the motor 20, respectively. The motor 20 has a housing 27 inclusive of a rotor, and also has a mounting face 26 that comes in contact with the frame 50 for mounting. The mounting face 26 has a boss 23 formed around the shaft extending from the center of the mounting face 26. A gear 24 is formed at the end of the shaft.

The mounting face 26 to come in contact with the frame 50 has a flange 22 at a periphery thereof projecting from the housing 27, and has a portion having a screw hole 21 also projecting from the housing 27 at the position opposite the flange 22. A connector 25 is situated at the side face of the housing 27 for connection with one end of the flexible printed circuit board 10.

When the motor 20 is mounted to the frame 50, the flange 22 of the motor 20 engages in a fitting part formed on the frame 50, thereby fixedly positioning the motor 20. The motor 20 is inserted into the frame 50 from the direction where the head spring 5 and the like are situated such that the gear 24 is exposed to outside. The motor 20 is then fixedly mounted to the frame 50, with the mounting face 26 in close contact with the sideboard of the frame 50.

Figure 3:
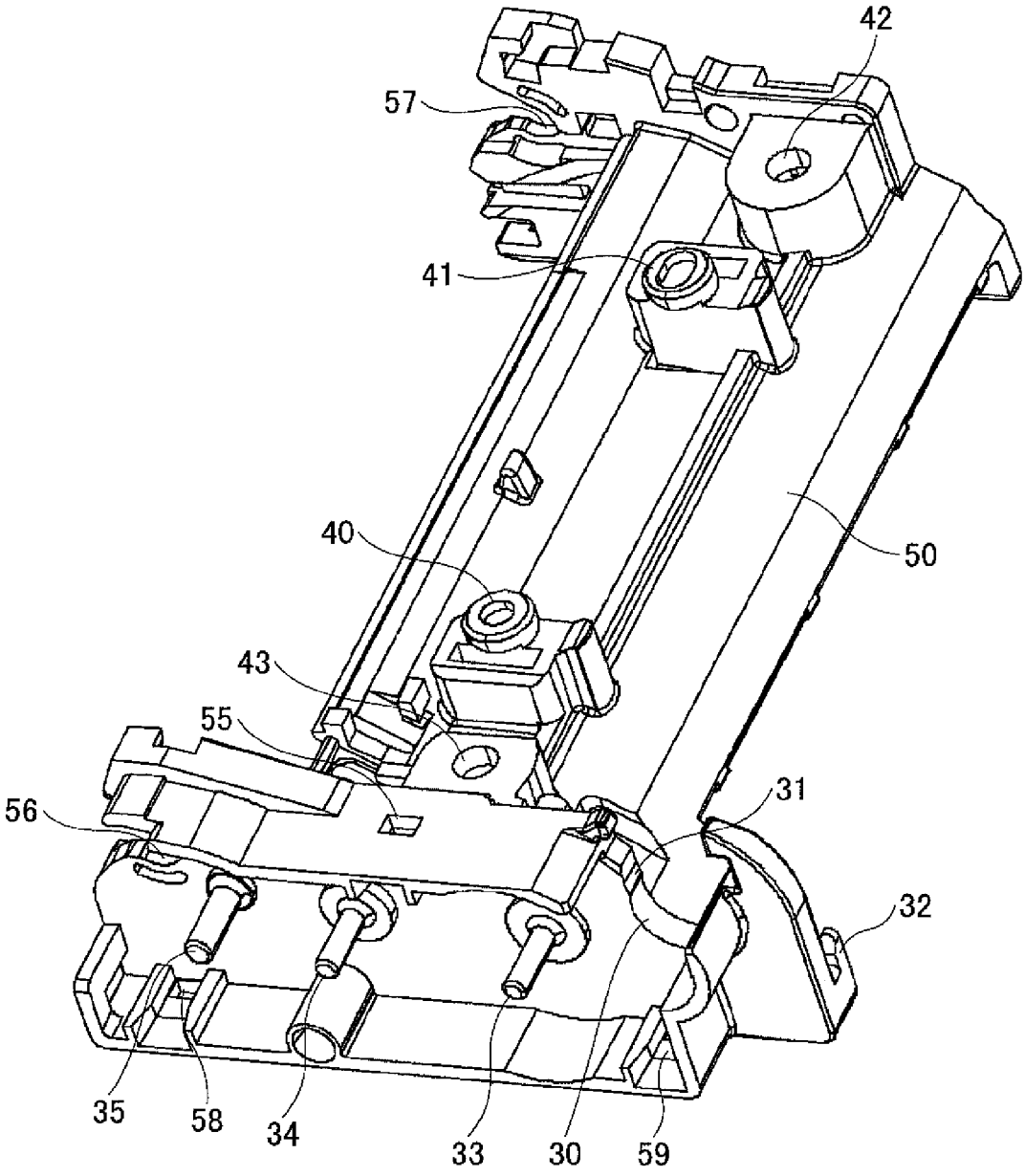
FIG. 3 is an oblique perspective view of a frame according to the embodiment.

FIG. 3 is an oblique perspective view of the frame 50. The frame 50 has the bosses 40 and 41 formed around the center thereof for fixedly mounting the head spring 5. Screw holes 43 and 42 are formed near the bosses 40 and 41, respectively, for fixedly mounting the head spring 5 to a housing case that contains a roll of thermal paper. The sideboards of the frame 50 have platen-roller receive parts 56 and 57 for supporting the platen roller 1, thereby making it possible to rotatably support the platen roller 1. The sideboard of the frame 50 on which the motor 20 is to be mounted has shafts 33, 34, and 35 for supporting gears that transmit the drive force of the motor 20 to the platen roller 1.

The sideboard of the frame 50 also has holes 55, 58, and 59 into which bosses of the gear cover are inserted, thereby fixedly mounting the gear cover that covers the gear 3 of the platen roller 1 and the gear 24 of the motor 20. The sideboard of the frame 50 also has a U-letter-shape opening 30 into which the boss 23 of the motor 20 is inserted in the direction perpendicular to the axis of the shaft, and also has a fitting part 32 in which the flange 22 of the motor 20 engages.

Figure 4C:
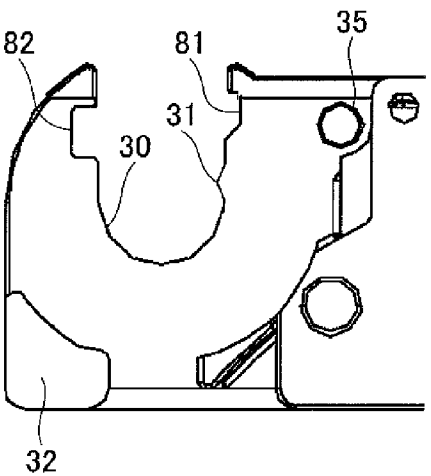
FIGS. 4A through 4C are enlarged views of the portion of the frame to which the motor is attached according to the embodiment.
Figure 4B:
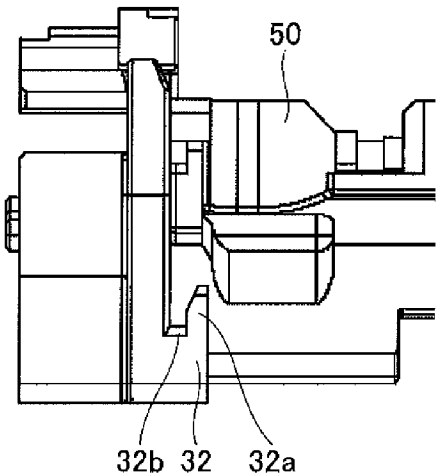
Figure 4A:
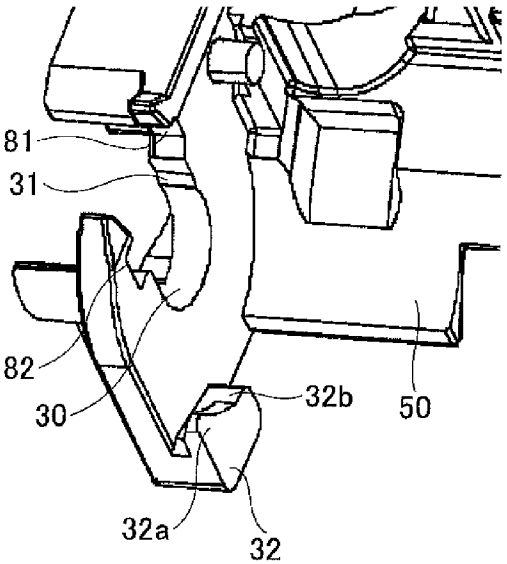

FIGS. 4A through 4C are enlarged views of the portion of the frame 50 to which the motor 20 is attached. FIG. 4A is an oblique perspective view of the portion of the frame 50 to which the motor 20 is attached. FIG. 4B is a front view of the same portion, and FIG. 4C is a lateral view of the same portion taken from inside the frame 50.

The U-letter-shape opening 30 of the frame 50 for receiving the motor 20 has a width equal to the diameter of the boss 23 of the motor 20, and the shape of a bottom part thereof complements the shape of the boss 23 (FIG. 4C). A projecting part 31 is formed at the side of the U-letter-shape opening 30 such that the projecting part 31 is in contact with the boss 23 when the motor 20 is mounted to the frame 50. The projecting part 31 serves to secure the boss 23 of the motor 20 that is mounted to the frame 50.

The U-letter-shape opening 30 has recesses 81 and 82 into which motor securing part of the gear cover is inserted as will be described later. This arrangement serves to fasten the motor securing part of the gear cover that secures the motor 20. The sideboard of the frame 50 on which the motor 20 is to be mounted has the fitting part 32 at the position matching the position of the flange 22 of the motor 20, and also has a screw hole 35 at the position matching the position of the screw hole 21 of the motor 20. The fitting part 32 of the frame 50 has a nipping part 32*a* for holding the flange 22 of the motor 20 between the nipping part 32*a* and the sideboard of the frame 50, and also has a bottom part 32*b* by which the flange 22 of the inserted motor 20 is stopped to position the motor 20 in its rotational direction.

The nipping part 32*a* to which the flange 22 of the motor 20 is inserted has a tapering end, which makes it easier for the flange 22 to be inserted. The nipping part 32*a* and the sideboard of the frame 50 securely hold the flange 22 of the motor 20 therebetween, thereby preventing the mounted motor 20 from being detached from the frame 50 toward inside the frame 50. The flange 22 is stopped by the bottom part 32*b* of the fitting part 32 upon coming in contact with the bottom part 32*b* when the motor 20 is inserted into the U-letter-shape opening 30, thereby fixedly positioning the motor 20 with respect to the rotational direction of the shaft.

Figure 5B:
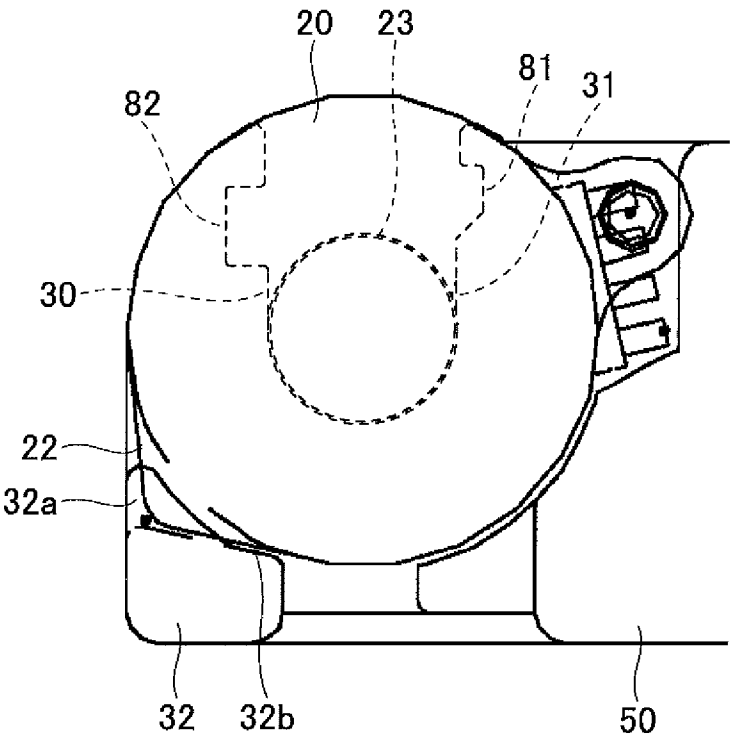
FIGS. 5A and 5B are drawings illustrating the way the motor is mounted to the frame according to the embodiment.
Figure 5A:
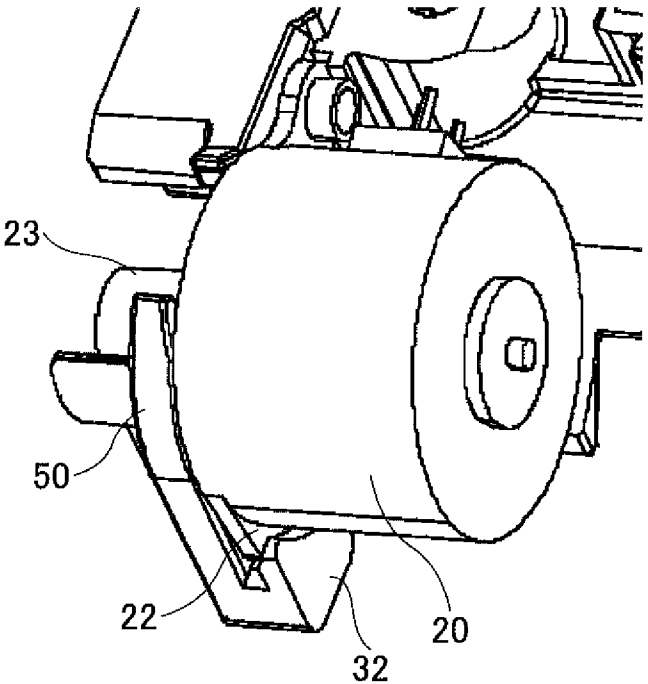

FIGS. 5A and 5B are drawings illustrating the way the motor 20 is attached to the frame 50. FIG. 5A illustrates the motor 20 in such a state that the boss 23 of the motor 20 is inserted into the U-letter-shape opening 30 of the sideboard of the frame 50 with the mounting face 26 of the motor 20 being in contact with the sideboard of the frame 50. FIG. 5B illustrates the motor 20 in such a state that the motor 20 mounted to the frame 50 is fixedly positioned by the fitting part 32 of the frame 50 engaging with the flange 22 of the motor 20. The boss 23 of the motor 20 is secured by the projecting part 31 formed at the side of the U-letter-shape opening 30 of the frame 50.

In this manner, insertion of the boss 23 into the U-letter-shape opening 30 of the frame 50 naturally results in the flange 22 being engaged in the fitting part 32 of the frame 50. With this arrangement, the motor 20 is positioned with respect to the rotational direction of the shaft, and is also secured without the possibility of being detached in the direction of the shaft.

Positioning tasks associated with the mounting of the motor 20 to the frame 50 are no longer necessary, thereby simplifying the task of mounting the motor 20 to increase productivity. Further, the motor 20 is reliably secured by simply inserting the motor 20 to the frame 50.

Figure 6B:
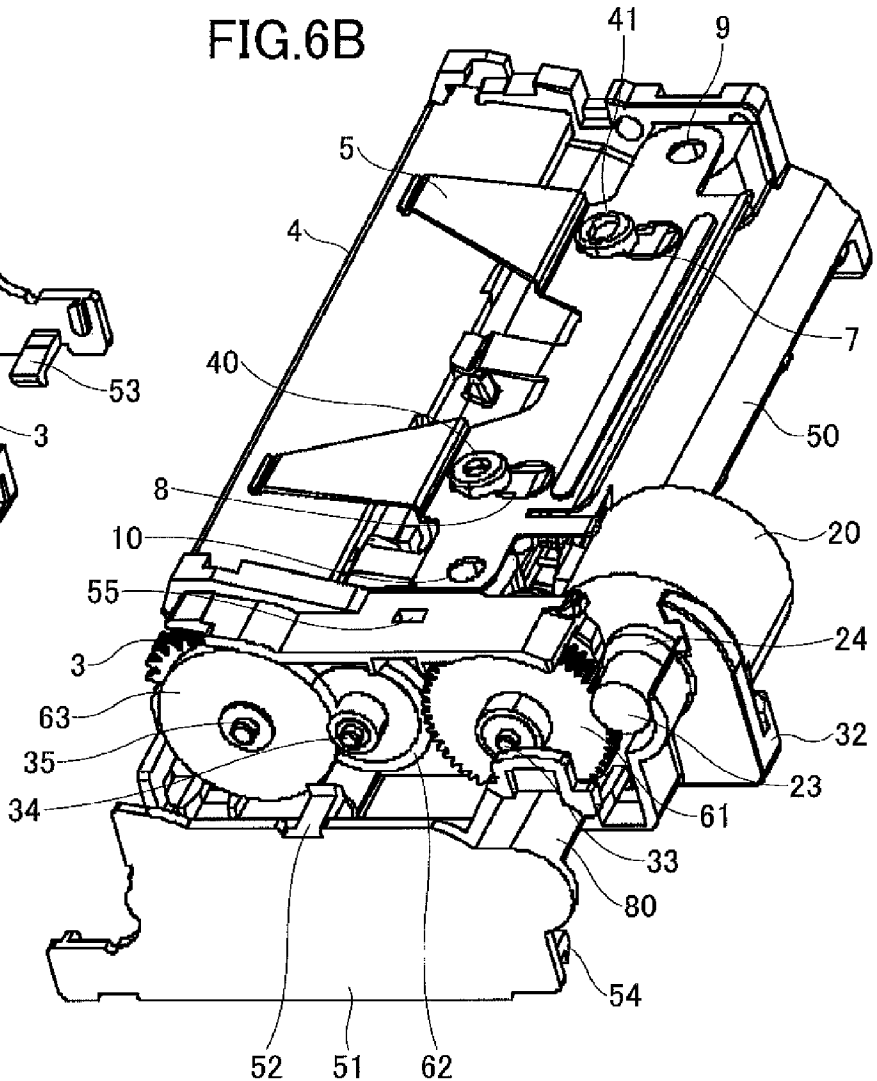
FIGS. 6A and 6B are drawings illustrating a gear cover according to the embodiment.
Figure 6A:
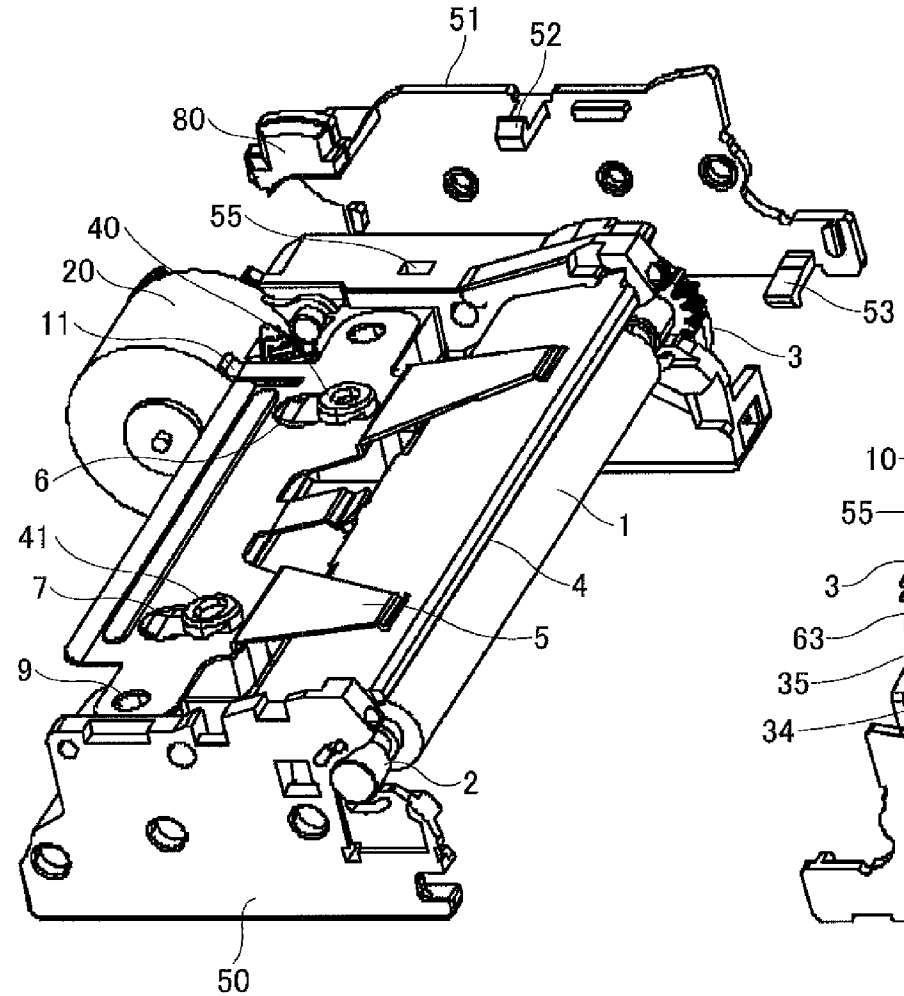

FIGS. 6A and 6B are drawings illustrating the gear cover 51 that covers the gear 3 of the platen roller 1 and the gear 24 of the motor 20. FIGS. 6A and 6B illustrate views of the thermal printer 100 taken from different directions, with the gear cover 51 being detached.

Gears 61, 62, and 63 for transmitting drive force from the gear 24 of the motor 20 to the gear 3 of the platen roller 1 are attached to the shafts 33, 34, and 35, respectively, at the sideboard of the frame 50. The gear cover 51 that covers these gears is attached to the sideboard of the frame 50 (see FIG. 6B). The gear cover 51 has bosses 52, 53, and 54 at the positions matching the positions of the holes 55, 58, and 59 (see FIG. 3) formed in the frame 50. The gear cover 51 is fixedly mounted to the frame 50 by the bosses and the holes to cover the gear 3 of the platen roller 1 and the gear 24 of the motor 20.

The gear cover 51 also has a motor securing part 80, which is inserted into the U-letter-shape opening 30 (see FIG. 3) of the frame 50 to come in contact with the boss 23 of the motor 20. The motor securing part 80 has such shape as to fill the U-letter-shape opening 30 of the frame 50 upon coming in contact with the boss 23 of the motor 20 when the gear cover 51 is fixedly mounted to the frame 50. The motor securing part 80 also presses down and secures the boss 23 of the motor 20 that is inserted into the U-letter-shape opening 30 of the frame 50.

Figure 7B:
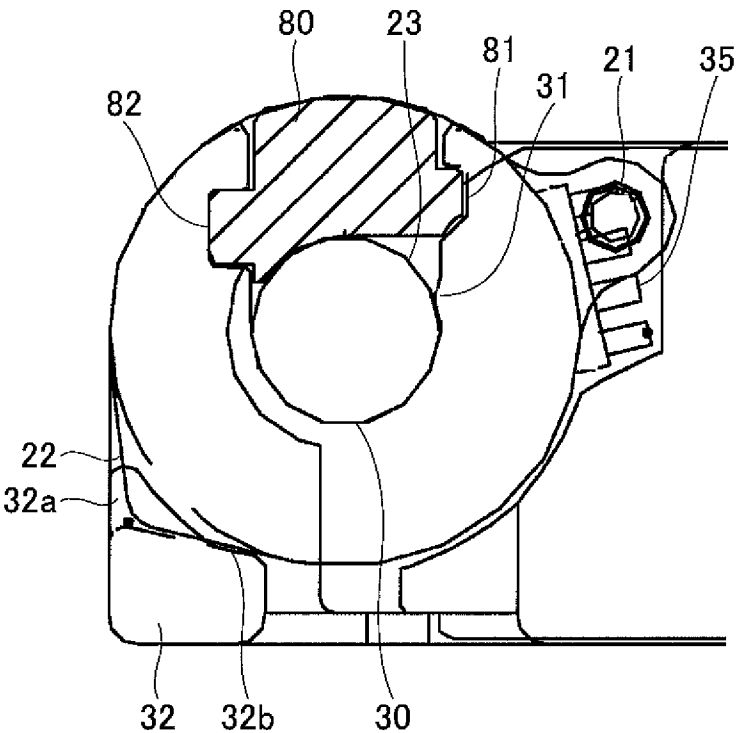
FIGS. 7A and 7B are enlarged views of the motor and the gear cover mounted to the frame according to the embodiment.
Figure 7A:
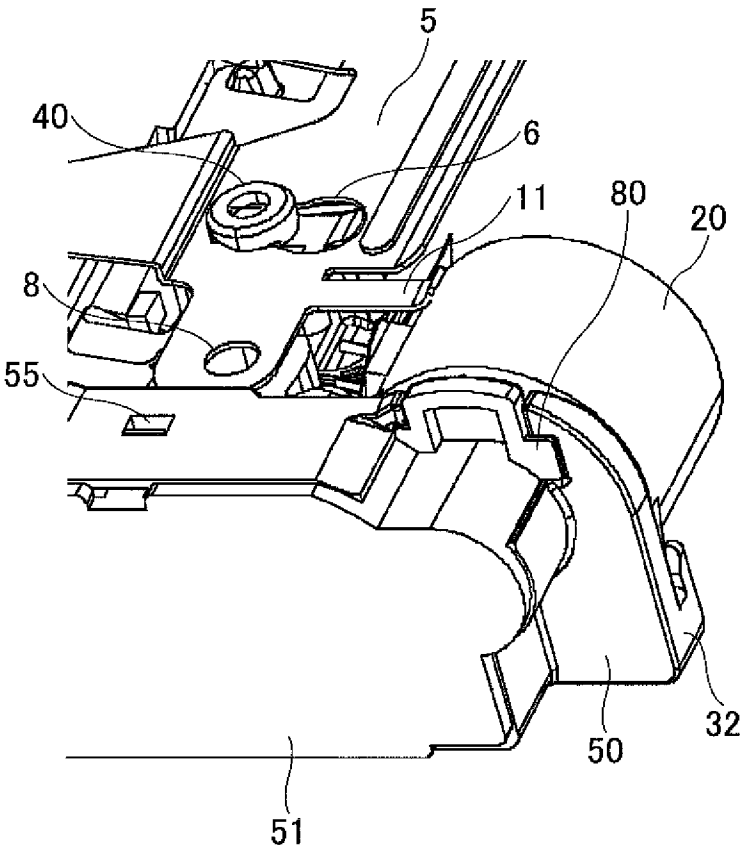

FIGS. 7A and 7B are drawings illustrating the motor 20 and the gear cover 51 that are mounted to the frame 50. The boss 23 of the motor 20 is inserted into the U-letter-shape opening 30 formed in the sideboard of the frame 50, and the flange 22 of the motor 20 is engaged in the fitting part 32 of the frame 50, so that the motor 20 is fixedly positioned.

The projecting part 31 formed at the side of the U-letter-shape opening 30 of the frame 50 is in contact with the boss 23 of the motor 20, thereby preventing the motor 20 from being detached from the U-letter-shape opening 30. The motor securing part 80 of the gear cover 51 is inserted into the U-letter-shape opening 30 of the frame 50 to press down and secure the motor 20.

In this manner, the provision of the flange 22 of the motor 20, the fitting part 32 and projecting part 31 of the frame 50, and the motor securing part 80 of the gear cover 51 ensures that the motor 20 be reliably fastened to the frame 50. The U-letter-shape opening 30 and fitting part 32 of the frame 50 thus make it easier to mount the motor 20, thereby increasing productivity, and also reliably fastening the motor 20.

As illustrated in FIGS. 1A and 13 and FIGS. 6A and 6B, the head spring 5 is mounted such that a contact part 11 formed at one end thereof comes in contact with the motor 20. The head spring 5 is a plate member made of metal material, and is mounted through mounting holes 8 and 9 to the housing case that contains a roll of thermal paper and the like. This arrangement makes it possible to discharge static charge accumulated in the motor 20 to the frame ground. Further, heat generated by the motion of the motor 20 is dissipated to the housing case through the head spring 5 that is in contact with the motor 20, which prevents the motor 20 from heating up. In this manner, the contact part 11 of the head spring 5 in contact with the motor 20 discharges static charge of the motor 20 that may cause a failure of the motor 20, and also serves to release heat, thereby making it possible to perform printing continuously in a stable manner.

According to the embodiment described heretofore, the U-letter-shape opening 30 for receiving the boss 23 of the motor 20 and the fitting part 32 for engaging with the flange 22 of the motor 20 are formed in the frame 50, thereby simplifying the task of mounting the motor 20 to the frame 50. Further, the provision of the projecting part 31 at the side of the U-letter-shape opening 30 of the frame 50, the fitting part 32, and the motor securing part 80 of the gear cover 51 ensures that the motor 20 be reliably fixed to the frame 50. Moreover, the motor 20 being in contact with the head spring 5 allows the static charge and heat of the motor 20 to be released, thereby making it possible to continuously perform stable printing operations.

Although a thermal printer, for which the task of positioning and fixing the motor being assembled with the frame is simplified, has been described heretofore by referring to one or more embodiments, the present invention is not limited to such embodiments. Various variations and modifications may be made without departing from the scope of the present invention.

The present application is based on Japanese priority application No. 2011-138863 filed on Jun. 22, 2011, with the Japanese Patent Office, the entire contents of which are hereby incorporated by reference.

What is claimed is:

1. A printer, comprising:

a platen roller;

a motor configured to rotate the platen roller; and a frame configured to rotatably support the platen roller, the motor being mounted to the frame, wherein the motor has a shaft and a face that is in contact with the frame, and the face has a flange at a periphery thereof and a boss around the shaft, wherein the frame has a U-letter-shape opening into which the boss of the motor is insertable in a direction perpendicular to an axis of the shaft, and has a fitting part in which the flange of the motor is engaged, and wherein the motor is fixedly positioned by the boss being inserted into the U-letter-shape opening of the frame and by the flange being engaged in the fitting part.

2. The printer as claimed in claim 1, wherein a projecting part is formed at a side of the U-letter-shape opening such that the projecting part is in contact with the boss of the motor mounted to the frame.

3. The printer as claimed in claim 1, further comprising a gear cover mounted to the frame to cover a gear of the platen roller and a gear of the motor, wherein the gear cover has a motor securing part that is inserted into the U-letter-shape opening to be in contact with the boss of the motor.

4. The printer as claimed in claim 1, further comprising:

a thermal head; and a head spring made of metal to urge the thermal head against the platen roller, wherein the head spring is configured to be in contact with the motor.

* * * * *